US006263982B1

(12) United States Patent
Hannegan et al.

(10) Patent No.: US 6,263,982 B1
(45) Date of Patent: Jul. 24, 2001

(54) METHOD AND SYSTEM FOR RETURN OF DRILLING FLUID FROM A SEALED MARINE RISER TO A FLOATING DRILLING RIG WHILE DRILLING

(75) Inventors: Don M. Hannegan, Fort Smith, AR (US); Darryl A. Bourgoyne, Baton Rouge, LA (US)

(73) Assignee: Weatherford Holding U.S., Inc., Houston, TX (US)

( * ) Notice: Subject to any disclaimer, the term of this patent is extended or adjusted under 35 U.S.C. 154(b) by 0 days.

(21) Appl. No.: 09/260,642

(22) Filed: Mar. 2, 1999

Related U.S. Application Data

(63) Continuation-in-part of application No. 09/033,190, filed on Mar. 2, 1998.

(51) Int. Cl.[7] ..... E21B 7/128

(52) U.S. Cl. ..... 175/7; 175/195

(58) Field of Search ..... 175/7, 5, 10, 195; 166/358

(56) References Cited

U.S. PATENT DOCUMENTS

| | | | |
|---|---|---|---|
| D. 282,073 | 1/1986 | Bearden et al. | D15/21 |
| 517,509 | 4/1894 | Williams . | |
| 1,157,644 | 10/1915 | London . | |
| 1,472,952 | 11/1923 | Anderson . | |
| 1,503,476 | 8/1924 | Childs et al. . | |
| 1,528,560 | 3/1925 | Meyers et al. . | |
| 1,546,467 | 7/1925 | Bennett . | |
| 1,560,763 | 11/1925 | Collins . | |
| 1,700,894 | 2/1929 | Joyce et al. . | |
| 1,708,316 | 4/1929 | MacClatchie . | |
| 1,769,921 | 7/1930 | Hansen . | |
| 1,776,797 | 9/1930 | Sheldon . | |
| 1,813,402 | 7/1931 | Hewitt . | |
| 1,831,956 | 11/1931 | Harrington . | |
| 1,836,470 | 12/1931 | Humason et al. . | |
| 1,902,906 | 3/1933 | Seamark . | |
| 1,942,366 | 1/1934 | Seamark | 166/14 |
| 2,036,537 | 4/1936 | Otis | 255/1 |
| 2,071,197 | 2/1937 | Burns et al. | 286/26 |
| 2,124,015 | 7/1938 | Stone et al. | 166/15 |
| 2,126,007 | 8/1938 | Guiberson et al. | 255/1 |
| 2,144,682 | 1/1939 | MacClatchie | 255/1 |
| 2,163,813 | 6/1939 | Stone et al. | 166/14 |
| 2,165,410 | 7/1939 | Penick et al. | 255/1 |
| 2,170,915 | 8/1939 | Schweitzer | 286/16 |
| 2,170,916 | 8/1939 | Schweitzer et al. | 255/1 |
| 2,175,648 | 10/1939 | Roach | 166/14 |
| 2,176,355 | 10/1939 | Otis | 255/1 |
| 2,185,822 | 1/1940 | Young | 285/97.9 |

(List continued on next page.)

OTHER PUBLICATIONS

"JIP's Work Brightens Outlook for UBD in Deep Waters" by Edson Yoshihito Nakagawa, Hekio Santos and Jose Carlos Cunha, American Oil & Gas Reporter, Apr. 1999, pp. 53, 56, 58–60 and 63.

(List continued on next page.)

*Primary Examiner*—Hoang Dang
(74) *Attorney, Agent, or Firm*—Akin, Gump, Strauss, Hauer & Feld, L.L.P.

(57) ABSTRACT

A floating rig or structure for drilling in the floor of an ocean using a rotatable tubular includes a seal housing having a rotatable seal connected above a marine riser fixed to the floor of the ocean. The seal rotating with the rotating tubular allows the riser and seal housing to maintain a predetermined pressure in the system that is desirable in underbalanced drilling, gas-liquid mud systems and pressurized mud handling systems. A flexible conduit or hose is used to compensate for the relative movement of the seal housing and the floating structure since the floating structure moves independent of the seal housing. A method for use of the system is also disclosed.

30 Claims, 11 Drawing Sheets

U.S. PATENT DOCUMENTS

| | | | | |
|---|---|---|---|---|
| 2,199,735 | | 5/1940 | Beckman | 255/1 |
| 2,222,082 | | 11/1940 | Leman et al. | 255/1 |
| 2,233,041 | | 2/1941 | Alley | 166/14 |
| 2,243,340 | | 5/1941 | Hild | 255/1 |
| 2,243,439 | | 5/1941 | Pranger et al. | 255/1 |
| 2,287,205 | | 6/1942 | Stone | 286/16 |
| 2,303,090 | | 11/1942 | Pranger et al. | 255/19 |
| 2,313,169 | | 3/1943 | Penick et al. | 166/14 |
| 2,325,556 | | 7/1943 | Taylor, Jr. et al. | 309/4 |
| 2,338,093 | | 1/1944 | Caldwell | 255/23 |
| 2,480,955 | | 9/1949 | Penick | 285/22 |
| 2,506,538 | | 5/1950 | Bennett | 255/23 |
| 2,529,744 | | 11/1950 | Schweitzer | 286/16 |
| 2,609,836 | | 9/1952 | Knox | 137/618 |
| 2,628,852 | | 2/1953 | Voytech | 286/11.14 |
| 2,646,999 | | 7/1953 | Barske | 286/9 |
| 2,649,318 | | 8/1953 | Skillman | 286/19 |
| 2,731,281 | | 1/1956 | Knox | 286/16.1 |
| 2,746,781 | | 5/1956 | Jones | 288/2 |
| 2,760,750 | | 8/1956 | Schweitzer, Jr. et al. | 251/2 |
| 2,760,795 | | 8/1956 | Vertson | 286/11.15 |
| 2,764,999 | | 10/1956 | Stanbury | 138/31 |
| 2,808,229 | | 10/1957 | Bauer et al. | 255/2.5 |
| 2,808,230 | | 10/1957 | McNeill et al. | 255/2.5 |
| 2,846,178 | | 8/1958 | Minor | 251/2 |
| 2,846,247 | | 8/1958 | Davis | 286/16.1 |
| 2,853,274 | | 9/1958 | Collins | 255/23 |
| 2,862,735 | | 12/1958 | Knox | 286/16.2 |
| 2,886,350 | | 5/1959 | Horne | 286/9 |
| 2,904,357 | | 9/1959 | Knox | 286/16.1 |
| 2,927,774 | | 3/1960 | Ormsby | 255/23 |
| 2,929,610 | * | 3/1960 | Stratton | 175/7 |
| 2,995,196 | | 8/1961 | Gibson et al. | 175/7 |
| 3,023,012 | | 2/1962 | Wilde | 277/31 |
| 3,029,083 | | 4/1962 | Wilde | 277/164 |
| 3,032,125 | * | 5/1962 | Hiser et al. | 175/7 |
| 3,033,011 | | 5/1962 | Garrett | 64/11 |
| 3,052,300 | | 9/1962 | Hampton | 166/84 |
| 3,100,015 | | 8/1963 | Regan | 166/46 |
| 3,128,614 | | 4/1964 | Auer | 64/23.5 |
| 3,134,613 | | 5/1964 | Regan | 285/142 |
| 3,176,996 | | 4/1965 | Barnett | 277/2 |
| 3,203,358 | | 8/1965 | Regan et al. | 103/203 |
| 3,216,731 | | 11/1965 | Dollison | 277/1 |
| 3,225,831 | | 12/1965 | Knox | 166/75 |
| 3,268,233 | | 8/1966 | Brown | 277/31 |
| 3,285,352 | | 11/1966 | Hunter | 175/214 |
| 3,288,472 | | 11/1966 | Watkins | 277/11 |
| 3,289,761 | | 12/1966 | Smith et al. | 166/27 |
| 3,294,112 | | 12/1966 | Watkins | 137/494 |
| 3,313,345 | * | 4/1967 | Fischer | 175/7 |
| 3,313,358 | * | 4/1967 | Postlewaite et al. | 175/7 |
| 3,323,773 | | 6/1967 | Walker | 251/1 |
| 3,333,870 | | 8/1967 | Watkins | 285/18 |
| 3,347,567 | | 10/1967 | Watkins | 285/24 |
| 3,360,048 | | 12/1967 | Watkins | 166/87 |
| 3,387,851 | | 6/1968 | Cugini | 277/2 |
| 3,400,938 | | 9/1968 | Williams | 277/31 |
| 3,445,126 | | 5/1969 | Watkins | 285/85 |
| 3,452,815 | | 7/1969 | Watkins | 166/0.5 |
| 3,472,518 | | 10/1969 | Harlan | 277/31 |
| 3,485,051 | | 12/1969 | Watkins | 61/46.5 |
| 3,492,007 | | 1/1970 | Jones | 277/31 |
| 3,493,043 | | 2/1970 | Watkins | 166/0.5 |
| 3,529,835 | | 9/1970 | Lewis | 277/2 |
| 3,603,409 | | 9/1971 | Watkins | 175/7 |
| 3,621,912 | | 11/1971 | Wooddy, Jr. | 166/0.5 |
| 3,631,834 | | 1/1972 | Gardner et al. | 115/34 |
| 3,638,721 | | 2/1972 | Harrison | 166/0.5 |
| 3,638,742 | | 2/1972 | Wallace | 175/325 |
| 3,653,350 | | 4/1972 | Koons et al. | 114/0.5 |
| 3,661,409 | | 5/1972 | Brown et al. | 285/82 |
| 3,664,376 | | 5/1972 | Watkins | 137/625.68 |
| 3,667,721 | | 6/1972 | Vujasinovic | 251/1 |
| 3,677,353 | | 7/1972 | Baker | 175/25 |
| 3,724,862 | | 4/1973 | Biffle | 277/31 |
| 3,779,313 | | 12/1973 | Regan | 166/0.6 |
| 3,827,511 | | 8/1974 | Jones | 175/25 |
| 3,868,832 | | 3/1975 | Biffle | 64/23.5 |
| 3,934,887 | | 1/1976 | Biffle | 277/31 |
| 3,952,526 | | 4/1976 | Watkins et al. | 61/46 |
| 3,955,622 | | 5/1976 | Jones | 166/0.5 |
| 3,965,987 | | 6/1976 | Biffle | 166/315 |
| 3,976,148 | * | 8/1976 | Maus et al. | 175/7 |
| 3,984,990 | | 10/1976 | Jones | 61/99 |
| 3,992,889 | | 11/1976 | Watkins et al. | 61/86 |
| 3,999,766 | | 12/1976 | Barton | 277/28 |
| 4,037,890 | | 7/1977 | Kurita et al. | 308/187 |
| 4,046,191 | | 9/1977 | Neath | 166/0.5 |
| 4,091,881 | * | 5/1978 | Maus | 175/7 |
| 4,098,341 | | 7/1978 | Lewis | 166/314 |
| 4,109,712 | | 8/1978 | Regan | 166/340 |
| 4,143,880 | | 3/1979 | Bunting et al. | 277/31 |
| 4,143,881 | | 3/1979 | Bunting | 277/31 |
| 4,149,603 | | 4/1979 | Arnold | 175/7 |
| 4,154,448 | | 5/1979 | Biffle | 277/31 |
| 4,157,186 | | 6/1979 | Murray et al. | 277/31 |
| 4,183,562 | | 1/1980 | Watkins et al. | 285/405 |
| 4,200,312 | | 4/1980 | Watkins | 285/18 |
| 4,208,056 | | 6/1980 | Biffle | 277/31 |
| 4,222,590 | | 9/1980 | Regan | 285/14 |
| 4,281,724 | | 8/1981 | Garrett | 175/195 |
| 4,282,939 | * | 8/1981 | Maus et al. | 175/7 |
| 4,285,406 | | 8/1981 | Garrett et al. | 175/195 |
| 4,291,772 | | 9/1981 | Beynet | 175/5 |
| 4,293,047 | | 10/1981 | Young | 175/195 |
| 4,304,310 | | 12/1981 | Garrett | 175/195 |
| 4,312,404 | | 1/1982 | Morrow | 166/84 |
| 4,326,584 | | 4/1982 | Watkins | 166/82 |
| 4,349,204 | | 9/1982 | Malone | 277/34 |
| 4,355,784 | | 10/1982 | Cain | 251/63 |
| 4,361,185 | | 11/1982 | Biffle | 166/84 |
| 4,363,357 | | 12/1982 | Hunter | 166/84 |
| 4,367,795 | | 1/1983 | Biffle | 166/84 |
| 4,383,577 | | 5/1983 | Pruitt | 166/95 |
| 4,398,599 | | 8/1983 | Murray | 166/95 |
| 4,406,333 | | 9/1983 | Adams | 175/209 |
| 4,413,653 | | 11/1983 | Carter, Jr. | 138/89 |
| 4,416,340 | | 11/1983 | Bailey | 175/195 |
| 4,423,776 | | 1/1984 | Wagoner et al. | 166/84 |
| 4,424,861 | | 1/1984 | Carter, Jr. et al. | 166/120 |
| 4,441,551 | | 4/1984 | Biffle | 166/84 |
| 4,444,250 | | 4/1984 | Keithahn et al. | 166/84 |
| 4,444,401 | | 4/1984 | Roche et al. | 277/30 |
| 4,448,255 | | 5/1984 | Shaffer et al. | 166/387 |
| 4,456,062 | | 6/1984 | Roche et al. | 166/84 |
| 4,456,063 | | 6/1984 | Roche | 166/84 |
| 4,480,703 | | 11/1984 | Garrett | 175/195 |
| 4,486,025 | | 12/1984 | Johnston | 277/31 |
| 4,500,094 | | 2/1985 | Biffle | 277/31 |
| 4,502,534 | | 3/1985 | Roche et al. | 166/84 |
| 4,524,832 | | 6/1985 | Roche et al. | 166/347 |
| 4,526,243 | | 7/1985 | Young | 175/195 |
| 4,529,210 | | 7/1985 | Biffle | 277/31 |
| 4,531,580 | | 7/1985 | Jones | 166/84 |
| 4,546,828 | | 10/1985 | Roche | 166/84 |
| 4,553,591 | | 11/1985 | Mitchell | 166/76 |
| 4,566,494 | | 1/1986 | Roche | 137/872 |
| 4,597,447 | | 7/1986 | Roche et al. | 166/347 |
| 4,618,314 | | 10/1986 | Hailey | 417/53 |
| 4,621,655 | | 11/1986 | Roche | 137/81.2 |

| | | | |
|---|---|---|---|
| 4,626,135 | 12/1986 | Roche | 405/195 |
| 4,646,844 | 3/1987 | Roche et al. | 166/379 |
| 4,697,484 | 10/1987 | Klee et al. | 82/1.5 |
| 4,719,937 | 1/1988 | Roche et al. | 137/114 |
| 4,745,970 | 5/1988 | Bearden et al. | 165/84 |
| 4,754,820 | 7/1988 | Watts et al. | 175/195 |
| 4,783,084 | 11/1988 | Biffle | 277/9 |
| 4,813,495 | 3/1989 | Leach | 175/6 |
| 4,825,938 | 5/1989 | Davis | 166/84 |
| 4,828,024 | 5/1989 | Roche | 166/84 |
| 4,832,126 | 5/1989 | Roche | 166/358 |
| 4,836,289 | 6/1989 | Young | 166/379 |
| 4,909,327 | 3/1990 | Roche | 166/359 |
| 4,949,796 | 8/1990 | Williams | 175/209 |
| 4,971,148 | 11/1990 | Roche et al. | 166/88 |
| 5,022,472 | 6/1991 | Bailey et al. | 175/195 |
| 5,028,056 | 7/1991 | Bemis et al. | 277/227 |
| 5,137,084 | 8/1992 | Gonzales et al. | 166/84 |
| 5,178,215 | 1/1993 | Yenulis et al. | 166/80 |
| 5,213,158 | 5/1993 | Bailey et al. | 166/82 |
| 5,215,151 | 6/1993 | Smith et al. | 175/45 |
| 5,224,557 | 7/1993 | Yenulis et al. | 175/195 |
| 5,647,444 | 7/1997 | Williams | 175/209 |
| 5,662,181 | 9/1997 | Williams et al. | 175/195 |

OTHER PUBLICATIONS

The Modular T BOP Stack System, Cameron Iron Works © 1985 (5 pages).

Cameron HC Collet Connector, © 1996 Cooper Cameron Corporation, Cameron Division (12 pages).

Riserless drilling: circumventing the size/cost cycle in deepwater—Conoco, Hydril project seek enabling technologies to drill in deepest water depths economically, May 1996 Offshore Drilling Technology (pp. 49, 50, 52, 53, 54 and 55).

Williams Tool Company—Home Page—Under Construction Williams Rotating Control Heads (2 pages); Seal–Ability for the pressures of drilling (2 pages); Williams Model 7000 Series Rotating Control Heads (1 page); Williams Model 7000 & 7100 Series Rotating Control Heads (2 pages); Williams Model IP1000 Rotating Control Head (2 pages); Williams Conventional Models 8000 & 9000 (2 pages); Applications Where using a Williams rotating control head while drilling is a plus (1 page); Williams higher pressure rotating control head systems are ideally suited for new technology flow drilling and closed loop underbalanced drilling (UBD) vertical and horizontal (2 pages); and How to Contact Us (2 pages).

Offshore—World Trends and Technology for Offshore Oil and Gas Operations, Mar. 1998, Seismic: Article entitled, "Shallow Flow Diverter JIP Spurred by Deepwater Washouts" (3 pages, including cover page, table of contents and p. 90).

Williams Tool Co., Inc. Rotating Control Heads and Strippers for Air, Gas, Mud, and Geothermal Drilling Worldwide—Sales Rental Services, ©1988 (19 pages).

Williams Tool Co., Inc. 19 page brochure ©1991 Williams Tool Co., Inc. (19 pages).

Fig. 14. Floating Piston Drilling Choke Design; May of 1997.

Blowout Preventer Testing for Underbalanced Drilling by Charles R. "Rick" Stone and Larry A. Cress, Signa Engineering Corp., Houston, Texas (24 pages) Sep. 1997.

Williams Tool Co., Inc. Instructions, Assemble & Disassemble Model 9000 Bearing Assembly (cover page and 27 numbered pages).

Williams Tool Co., Inc. Rotating Control Heads Making Drilling Safer While Reducing Costs Since 1968, ©1989 (4 pages).

Williams Tool Company, Inc. International Model 7000 Rotating Control Head, © 1991 (4 pages).

Williams Rotating Control Heads, Reduce Costs Increase Safety Reduce Environmental Impact (4 pages).

Williams Tool Co., Inc., Sales–Rental–Service, Williams Rotating Control Heads and Strippers for Air, Gas, Mud, and Geothermal Drilling, © 1982 (7 pages).

Williams Tool Co., Inc., Rotating Control Heads and Strippers for Air, Gas, Mud, Geothermal and Pressure Drilling, © 1991 (19 pages).

An article—The Brief Jan. '96, The Brief's Guest Columnists, Williams Tool Co., Inc., Communicating Dec. 13, 1995 (Fort Smith, Arkansas) The When? and Why? of Rotating Control Head Usage, Copyright © Murphy Publishing, Inc. 1996 (2 pages).

A reprint from the Oct. 9, 1995 edition of Oil & Gas Journal, "Rotating control head applications increasing", by Adam T. Bourgoyne, Jr., Copyright 1995 by Penn Well Publishing Company (6 pages).

1966–1967 Composite Catalog–Grant Rotating Drilling Head for Air, Gas or Mud Drilling, (1 page).

1976–1977 Composite Catalog Grant Oil Tool Company Rotating Drilling Head Models 7068, 7368, 8068 (Patented), Equally Effective with Air, Gas, or Mud Circulation Media (3 pages).

A Subsea Rotating Control Head for Riserless Drilling Applications, Darrly A. Bourgoyne, BEI; Adam T. Bourgoyne, Jr., Louisiana State University; and Don Hannegan, Williams Tool Company, Inc. Copyright 1998 (pp. 1–14).

Williams Tool Co., Inc., "Rotating Control Heads and Strippers for Air, Gas, Mud, and Geothermal Drilling," cover and pp. 1–16, Fort Smith, Arkansas 1988.

Williams Tool Co., Inc., "Rotating Control Heads and Strippers for Air, Gas, Mud, Geothermal cover and Drilling," pp. 1–16, Fort Smith, Arkansas 1991.

Hannegan, "Applications Widening for Rotating Control Heads," Drilling Contractor, cover page, table of contents and pp. 17–19, Drilling Contractor Publications, Inc., Houston, Texas Jul., 1996.

Composite Catalog, Hughes Offshore 1986–87 Subsea Systems and Equipment, Hughes Drilling Equipment Composite Catalog (pp. 2986–3004).

Williams Tool Co., Inc., Technical Specifications Model for The Model 7100, (3 pages).

Williams Tool Co., Inc. Website, Underbalanced Drilling (UBD), The Attraction of UBD (2 pages).

Williams Tool Co., Inc. Website, "Applications, Where Using a Williams Rotating Control Head While Drilling is a Plus" (2 pages).

Williams Tool Co., Inc. Website, "Model 7100," (3 pages).

Composite Catalog, Hughes Offshore 1982/1983, Regan Products, © Copyright 1982, (Two cover sheets and 4308–27 thru 4308–43, and end sheet) See p. 4308–36 Type KFD Diverter.

Coflexip Brochure; —Coflexip Sales Offices, —The Flexible Steel Pipe for Drilling and Service Applications, 3–New 5" I.D. General Drilling Flexible, 4–Applications, and 5–Illustration (5 unnumbered pages).

Baker, Ron, "A Primer of Oilwell Drilling", Fourth Edition, Published by Petroleum Extension Service, The University of Texas at Austin, Austin, Texas, in cooperation with International Association of Drilling Contractors Houston Texas © 1979, (3 cover pages and pp. 42–49 re Circulation System).

Brochure, Lock down Lubricator System, Dutch Enterprises Inc., "Safety with Savings," (cover sheet and 16 unnumbered pages) See above U.S. application No. 4,836,289 referred to therein.

Hydril GL series Annular Blowout Preventers (Patented—see Roche patents above), (cover sheet and 2 pages).

Other Hydril Product Information (The GH Gas Handler Series Product is Listed), © 1996, Hydril Company (Cover sheet and 19 pages).

Brochure, Shaffer Type 79 Rotating Blowout Preventer, NL Rig Equipment/NL Industries, Inc., (6 unnumbered pages). Shaffer, A Varco Company, (Cover page and pp. 1562–1568).

Avoiding Explosive Unloading of Gas in a Deep Water Riser When SOBM is in Use; Colin P. Leach & Joseph R. Roche—1998 (The Paper Describes an Application for the Hydril Gas Handler, The Hydril GH 211–2000 Gas Handler is Depicted in Figure 1 of the Paper), (9 unnumbered pages).

Feasibility Study of Dual Density Mud System for Deepwater Drilling Operations; Clovis A. Lopes & A. T. Bourgoyne Jr.—1997 (Offshore Technology Conference Paper Number 8465), (pp. 257–266).

A Subsea Rotating Control Head for Riserless Drilling Applications; Darryl A. Bourgoyne, Adam T. Bourgoyne, and Don Hannegan—1998 (International Association of Drilling Contractors International Deep Water Well Control Conference held in Houston, Texas, Aug. 26–27, 1998), (14 pages).

April 1998 Offshore Drilling with Light Weight Fluids Joint Industry Project Presentation, (9 unnumbered pages).

Nakagawa, Edson Y., Santos, Helio and Cunha, J.C., "Application of Aerated–Fluid Drilling in Deepwater", SPE/IADC 52787 Presented by Don Hannegan, P.E., SPE ©1999 SPE/IADC Drilling Conference, Amsterdam, Holland, Mar. 9–11, 1999 (5 unnumbered pages).

Brochure: "Inter–Tech Drilling Solutions Ltd.'s RBOP™ Means Safety and Experience for Underbalanced Drilling", Inter–Tech Drilling Solutions Ltd./Big D Rentals & Sales (1981) Ltd. and Color Copy of "Rotating BOP" (2 unnumbered pages).

"Pressure Control While Drilling", Shaffer® A Varco Company, Rev. A (2 unnumbered pages).

Field Exposure (As of Aug. 1998), Shaffer® A Varco Company (1 unnumbered page).

Graphic: "Rotating Spherical BOP" (1 unnumbered page).

* cited by examiner

METHOD AND SYSTEM FOR RETURN OF DRILLING FLUID FROM A SEALED MARINE RISER TO A FLOATING DRILLING RIG WHILE DRILLING

CROSS-REFERENCE TO RELATED APPLICATIONS

This is a continuation-in-part of U.S. Ser. No. 9/033,190 filed Mar. 2, 1998, entitled METHOD AND APPARATUS FOR DRILLING A BOREHOLE INTO A SUBSEA ABNORMAL PORE PRESSURE ENVIRONMENT

STATEMENT REGARDING FEDERALLY SPONSORED RESEARCH

Not applicable.

BACKGROUND OF THE INVENTION

1. Field of the Invention

The present invention relates to a method and system for a floating structure using a marine riser while drilling. In particular, the present invention relates to a method and system for return of drilling fluid from a sealed marine riser to a floating structure while drilling in the floor of an ocean using a rotatable tubular.

2. Description of the Related Art

Marine risers extending from a wellhead fixed on the floor of an ocean have been used to circulate drilling fluid back to a floating structure or rig. The riser must be large enough in internal diameter to accommodate the largest bit and pipe that will be used in drilling a borehole into the floor of the ocean. Conventional risers now have internal diameters of approximately 20 inches, though other diameters are and can be used.

An example of a marine riser and some of the associated drilling components, such as shown in FIG. 1, is proposed in U.S. Pat. No. 4,626,135, assigned on its face to Hydril Company, which is incorporated herein by reference for all purposes. Since the riser R is fixedly connected between the floating structure or rig S and the wellhead W, as proposed in the '135 patent, a conventional slip or telescopic joint SJ, comprising an outer barrel OB and an inner barrel IB with a pressure seal therebetween, is used to compensate for the relative vertical movement or heave between the floating rig and the fixed riser. Diverters D have been connected between the top inner barrel IB of the slip joint SJ and the floating structure or rig S to control gas accumulations in the subsea riser R or low pressure formation gas from venting to the rig floor F.

One proposed diverter system is the TYPE KFDS diverter system, previously available from Hughes Offshore, a division of Hughes Tool Company, for use with a floating rig. The KFDS system's support housing SH, shown in FIG. 1A, is proposed to be permanently attached to the vertical rotary beams B between two levels of the rig and to have a full opening to the rotary table RT on the level above the support housing SH. A conventional rotary table on a floating drilling rig is approximately 49½ inches in diameter. The entire riser, including an integral choke line CL and kill line KL, are proposed to be run-through the KFDS support housing. The support housing SH is proposed to provide a landing seat and lockdown for a diverter D, such as a REGAN diverter also supplied by Hughes Offshore. The diverter D includes a rigid diverter lines DL extending radially outwardly from the side of the diverter housing to communicate drilling fluid or mud from the riser R to a choke manifold CM, shale shaker SS or other drilling fluid receiving device. Above the diverter D is the rigid flowline RF, shown configured to communicate with the mud pit MP in FIG. 1, the rigid flowline RF has been configured to discharge into the shale shakers SS or other desired fluid receiving devices. If the drilling fluid is open to atmospheric pressure at the bell-nipple in the rig floor F, the desired drilling fluid receiving device must be limited by an equal height or level on the structure S or, if desired, pumped by a pump up to a higher level. While the choke manifold CM, separator MB, shale shaker SS and mud pits MP are shown schematically in FIG. 1, if a bell-nipple were at the rig floor F level and the mud return system was under minimal operating pressure, these fluid receiving devices may have to be located at a level below the rig floor F for proper operation. Hughes Offshore has also provided a ball joint BJ between the diverter D and the riser R to compensate for other relative movement (horizontal and rotational) or pitch and roll of the floating structure S and the fixed riser R Because both the slip joint and the ball joint require the use of sliding pressure seals, these joints need to be monitored for proper seal pressure and wear. If the joints need replacement, significant rig down-time can be expected. Also, the seal pressure rating for these joints may be exceeded by emerging and existing drilling techniques that require surface pressure in the riser mud return system, such as in underbalanced operations comprising drilling, completions and workovers, gas-liquid mud systems and pressurized mud handling systems. Both the open bell-nipple and seals in the slip and ball joints create environmental issues of potential leaks of fluid.

Returning to FIG. 1, the conventional flexible choke line CL has been configured to communicate with a choke manifold CM. The drilling fluid then can flow from the manifold CM to a mud-gas buster or separator MB and a flare line (not shown). The drilling fluid can then be discharged to a shale shaker SS to mud pits and pumps MP. In addition to a choke line CL and kill line KL, a booster line BL can be used. An example of some of the flexible conduits now being used with floating rigs are cement lines, vibrator lines, choke and kill lines, test lines, rotary lines and acid lines.

Therefore, a floating rig mud return system that could replace the conventional slip and ball joints, diverter and bell-nipple with a seal below the rig floor between the riser and rotating tubular would be desirable. More particularly it would be desirable to have a seal housing, that moves independent of the floating rig or structure but with the rotatable tubular to reduce vertical movement between the rotating seal and tubular, that includes a flexible conduit or flowline from the seal housing to the floating structure to compensate for resulting relative movement of the structure and the seal housing. Furthermore, it would be desirable if the seal between the riser and the rotating tubular would be accessible for ease in inspection, maintenance and for quick change-out.

SUMMARY OF THE INVENTION

A system is disclosed for use with a floating rig or structure for drilling in the floor of an ocean using a rotatable tubular. A seal housing having a rotatable seal is connected to the top of a marine riser fixed to the floor of the ocean. The seal housing includes a first housing opening sized to discharge drilling fluid pumped down the rotatable tubular and then moved up the annulus of the riser. The seal rotating with the rotatable tubular allows the riser and seal housing to maintain a predetermined pressure in the fluid or mud return system that is desirable in underbalanced drilling, gas-liquid mud systems and pressurized mud handling systems. A flexible conduit or hose is used to compensate for the relative movement of the seal housing and the floating structure since the floating structure moves independent of the seal housing. This independent movement of seal housing relative to the floating structure allows the seal rotating with the tubular to experience reduced vertical movement while drilling.

Advantageously, a method for use of the system is also disclosed.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF INVENTION

Figure 2:
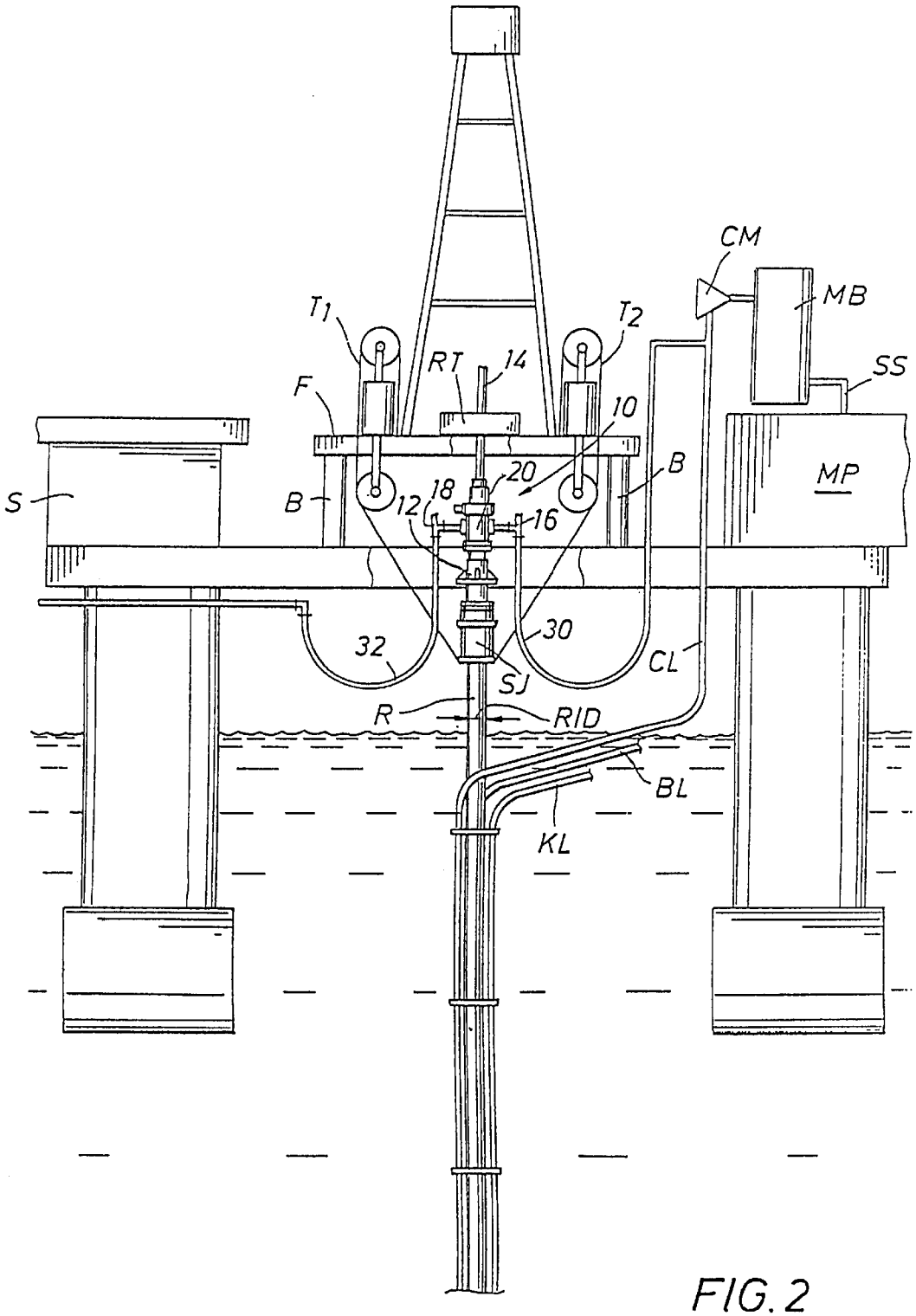
FIG. 2 is an enlarged elevational view of the floating rig mud return system of the present invention.
Figure 3:
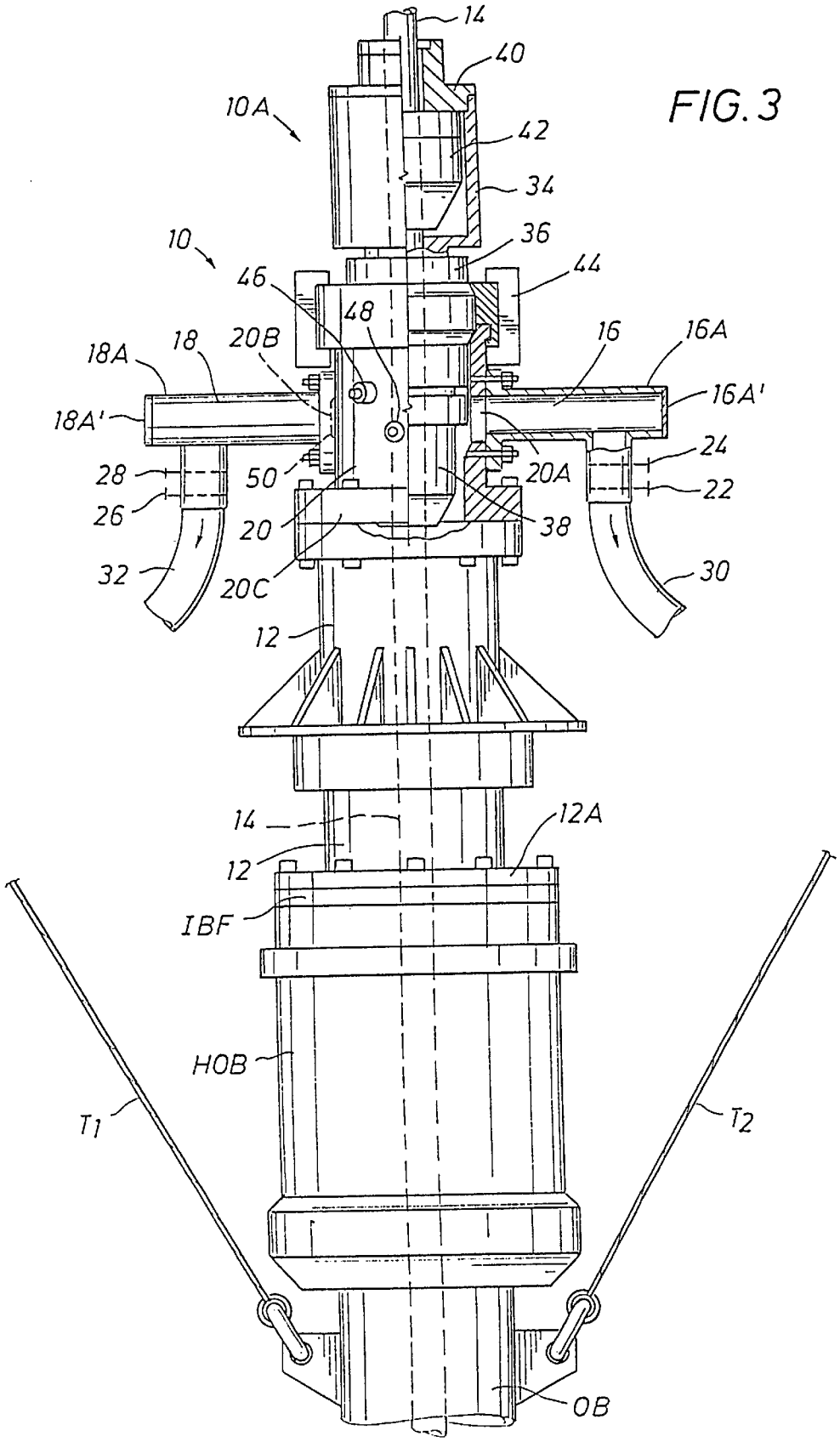
FIG. 3 is an enlarged view of the seal housing of the present invention positioned above the riser with the rotatable seal in the seal housing engaging a rotatable tubular.
Figure 4:
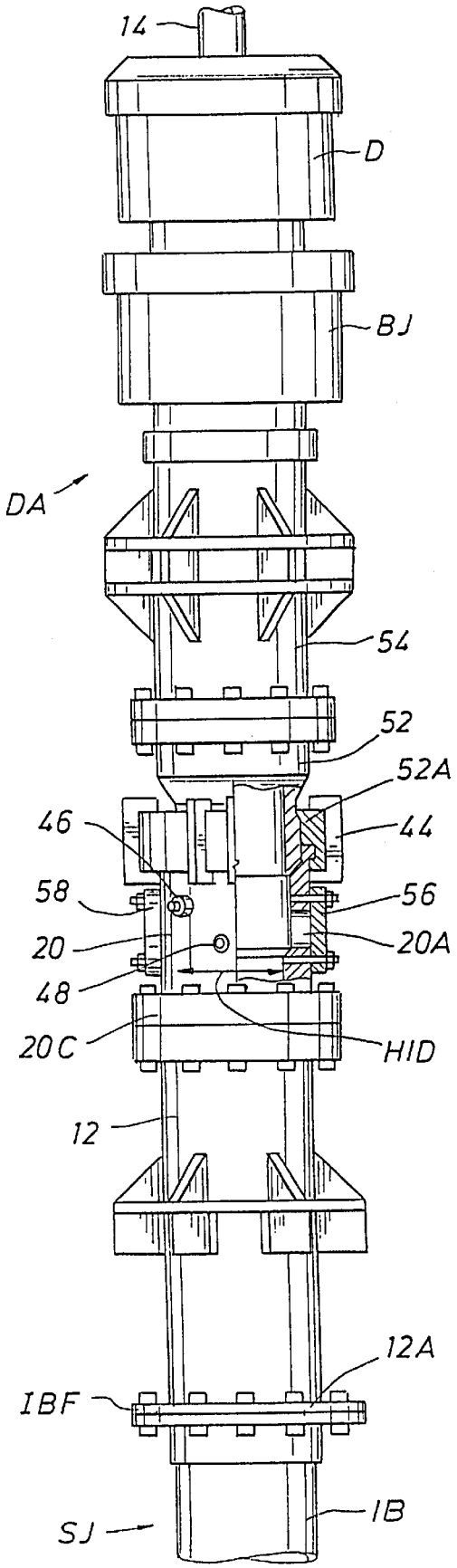
FIG. 4 is an elevational view of a diverter assembly substituted for a bearing and seal assembly in the seal housing of the present invention for conventional use of a diverter and slip and ball joints with the riser.
Figure 5:
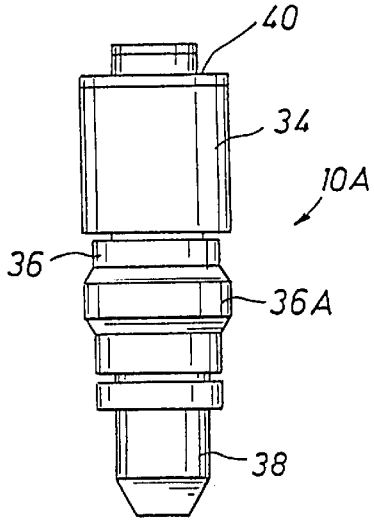
FIG. 5 is the bearing and seal assembly of the present invention removed from the seal housing.

FIGS. 2, 3 and 6 to 8 disclose the preferred embodiment of the present invention and FIG. 4 shows an embodiment of the invention for use of a conventional diverter and slip and ball joints after removing the bearing and seal assembly of the present invention as illustrated in FIG. 5, from the seal housing, as will be discussed below in detail.

FIG. 2 illustrates a rotating blowout preventor or rotating control head, generally designated as 10, of the present invention. This rotating blowout preventor or rotating control head 10 is similar, except for modifications to be discussed below, to the rotating blowout preventor disclosed in U.S. Pat. No. 5,662,181, assigned to the assignee of the present invention, Williams Tool Company, Inc. of Fort Smith, Ark. The '181 patent, incorporated herein by reference for all purposes, discloses a product now available from the assignee that is designated Model 7100. The modified rotating blowout preventor 10 can be attached above the riser R, when the slip joint SJ is locked into place, such as shown in the embodiment of FIG. 2, so that there is no relative vertical movement between the inner barrel IB and outer barrel DB of the slip joint SJ. It is contemplated that the slip joint SJ will be removed from the riser R and the rotating blowout preventor 10 attached directly to the riser R. In either embodiment of a locked slip joint (FIG. 2) or no slip joint (not shown), an adapter or crossover 12 will be positioned between the preventor 10 and the slip joint SJ or directly to the riser R, respectively. As is known, conventional tensioners T1 and T2 will be used for applying tension to the riser R. As can be seen in FIGS. 2 and 3, a rotatable tubular 14 is positioned through the rotary table RT, through the rig floor F, through the rotating blowout preventor 10 and into the riser R for drilling in the floor of the ocean. In addition to using the BOP stack as a complement to the preventor 10, a large diameter valve could be placed below the preventor 10. When no tubulars are inside the riser R, the valve could be closed and the riser could be circulated with the booster line BL. Additionally, a gas handler, such as proposed in the Hydril '135 patent, could be used as a backup to the preventor 10. For example, if the preventor 10 developed a leak while under pressure, the gas handler could be closed and the preventor 10 seal(s) replaced.

Target T-connectors 16 and 18 preferably extend radially outwardly from the side of the seal housing 20. As best shown in FIG. 3, the T-connectors 16, 18 comprise terminal T-portions 16A and 18A, respectively, that reduce erosion caused by fluid discharged from the seal housing 20. Each of these T-connectors 16, 18 preferably include a lead "target" plate in the terminal T-portions 16A and 18A to receive the pressurized drilling fluid flowing from the seal housing 20 to the connectors 16 and 18. Additionally, a remotely operable valve 22 and a manual valve 24 are provided with the connector 16 for closing the connector 16 to shut off the flow of fluid, when desired. Remotely operable valve 26 and manual valve 28 are similarly provided in connector 18. As shown in FIGS. 2 and 3, a conduit 30 is connected to the connector 16 for communicating the drilling fluid from the first housing opening 20A to a fluid receiving device on the structure S. The conduit 30 communicates fluid to a choke manifold CM in the configuration of FIG. 2. Similarly, conduit 32, attached to connector 18, though shown discharging into atmosphere could be discharged to the choke manifold CM or directly to a separator MB or shale shaker SS. It is to be understood that the conduits 30, 32 can be a elastomer hose; a rubber hose reinforced with steel; a flexible steel pipe such as manufactured by Coflexip International of France, under the trademark "COFLEXIP", such as their 5" internal diameter flexible pipe; shorter segments of rigid pipe connected by flexible joints and other flexible conduit known to those of skill in the art.

Figure 1:
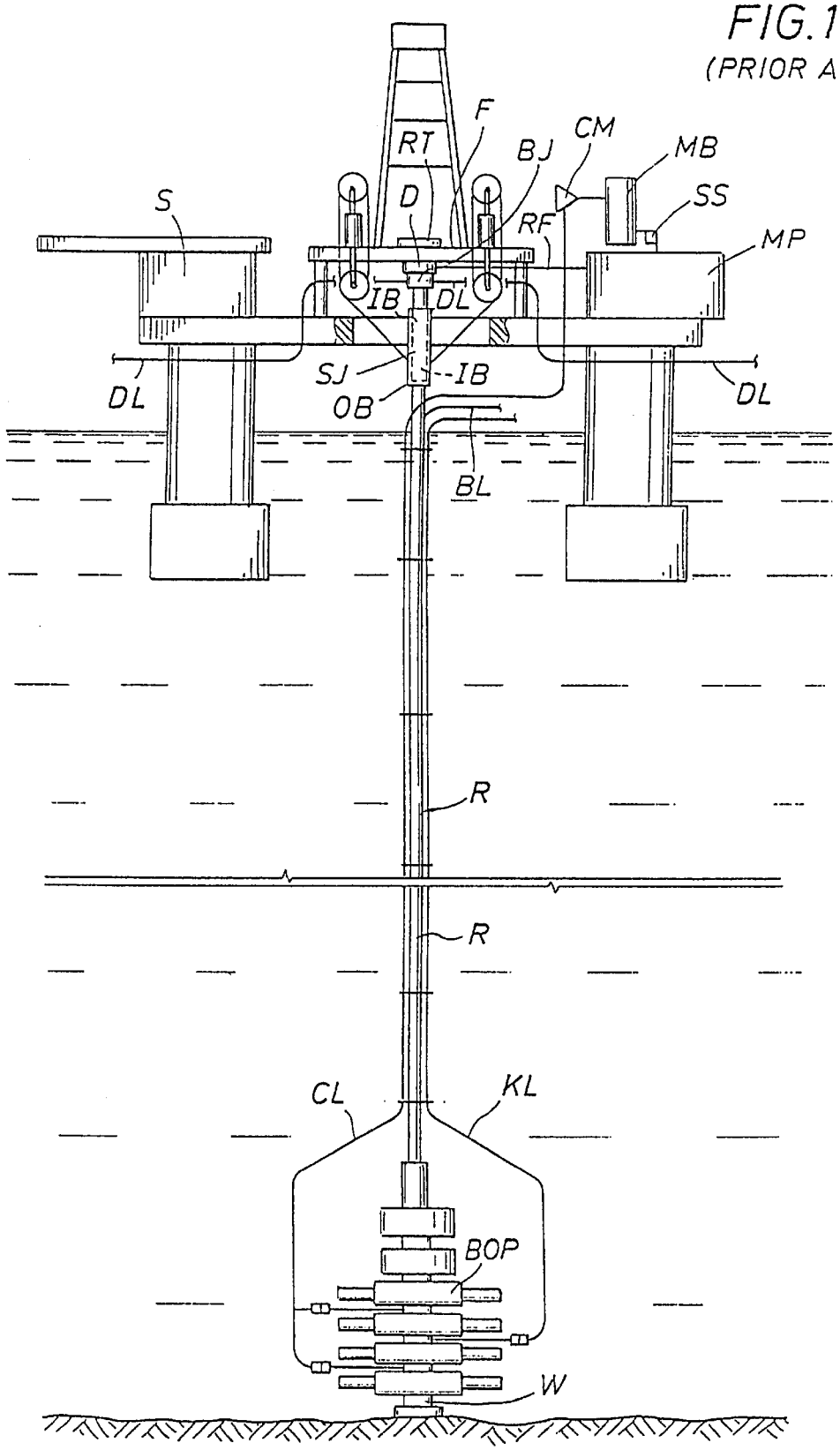
FIG. 1 (PRIOR ART)
FIG. 1 is an elevational view of a prior art floating rig mud return system shown in broken view with the lower portion illustrating the conventional subsea blowout preventor stack attached to a wellhead and the upper portion illustrating the conventional floating rig where a riser is connected to the floating rig and conventional slip and ball joints and diverters are used.

Turning now to FIG. 3, the rotating blowout preventor 10 is shown in more detail and in section view to better illustrate the bearing and seal assembly 10A. In particular, the bearing and seal assembly 10A comprises a top rubber pot 34 connected to the bearing assembly 36, which is in turn connected to the bottom stripper rubber 38. The top drive 40 above the top stripper rubber 42 are also components of the bearing and seal assembly 10A. Additionally, a quick disconnect/connect clamp 44, as disclosed in the '181 patent, is provided for connecting the bearing and seal assembly 10A to the seal housing or bowl 20. As discussed in more detail in the '181 patent, when the rotatable tubular 14 is tripped out of the preventor 10, the clamp 44 can be quickly disengaged to allow removal of the bearing and seal assembly 10A, as best shown in FIG. 5. Advantageously, upon removal of the bearing and seal assembly 10A, as shown in FIG. 4, the internal diameter HID of the seal housing 20 is substantially the same as the internal diameter RID of the riser R, as indicated in FIG. 1, to provide a substantially full bore access to the riser R.

Returning again to FIG. 3, while the rotating preventor 10 of the present invention is similar to the rotating preventor described in the '181 patent, the housing or bowl 20 includes first and second housing openings 20A, 20B opening to their respective connector 16, 18. The housing 20 further includes four holes, two hole 46, 48 shown in FIGS. 3 and 4, for receiving locking pins and locating pins, as will be discussed below in detail. In the additional second opening 20B, a rupture disk 50 is engineered to preferably rupture at approximately 500 PSI. The seal housing 20 is preferably attached to an adapter or crossover 12, that is available from ABB Vetco Gray. The adapter 12 is connected between the seal housing flange 20C and the top of the inner barrel IB. When using the rotating blowout preventor 10, as shown in FIG. 3, movement of the inner barrel IB of the slip joint SJ is locked with respect to the outer barrel OB and the inner barrel flange IBF is connected to the adapter bottom flange 12A. In other words, the head of the outer barrel HOB, that contains the seal between the inner barrel IB and the outer barrel OB, stays fixed relative to the adapter 12.

Turning now to FIG. 4, an embodiment is shown where the adapter 12 is connected between the seal housing 20 and an operational or unlocked inner barrel IB of the slip Joint SJ. In this embodiment, the bearing and seal assembly 10A, as such as shown in FIG. 5, is removed after using the quick disconnect/connect clamp 44. If desired the connectors 16, 18 and the conduits 30, 32, respectively, can remain connected to the housing 20 or the operator can choose to use a blind flange 56 to cover the first housing opening 20A and/or a blind flange 58 to cover the second housing opening 20B. If the connectors 16, 18 and conduits 30, 32, respectively, are not removed the valves 22 and 24 on connector 16 and, even though the rupture disk 50 is in place, the valves 26 and 28 on connector 18 are closed. Another modification to the seal housing 20 from the housing shown in the '181 patent is the use of studded adapter flanges instead of a flange accepting stud bolts, since studded flanges require less clearance for lowering the housing through the rotary table RT.

Figure 1A:
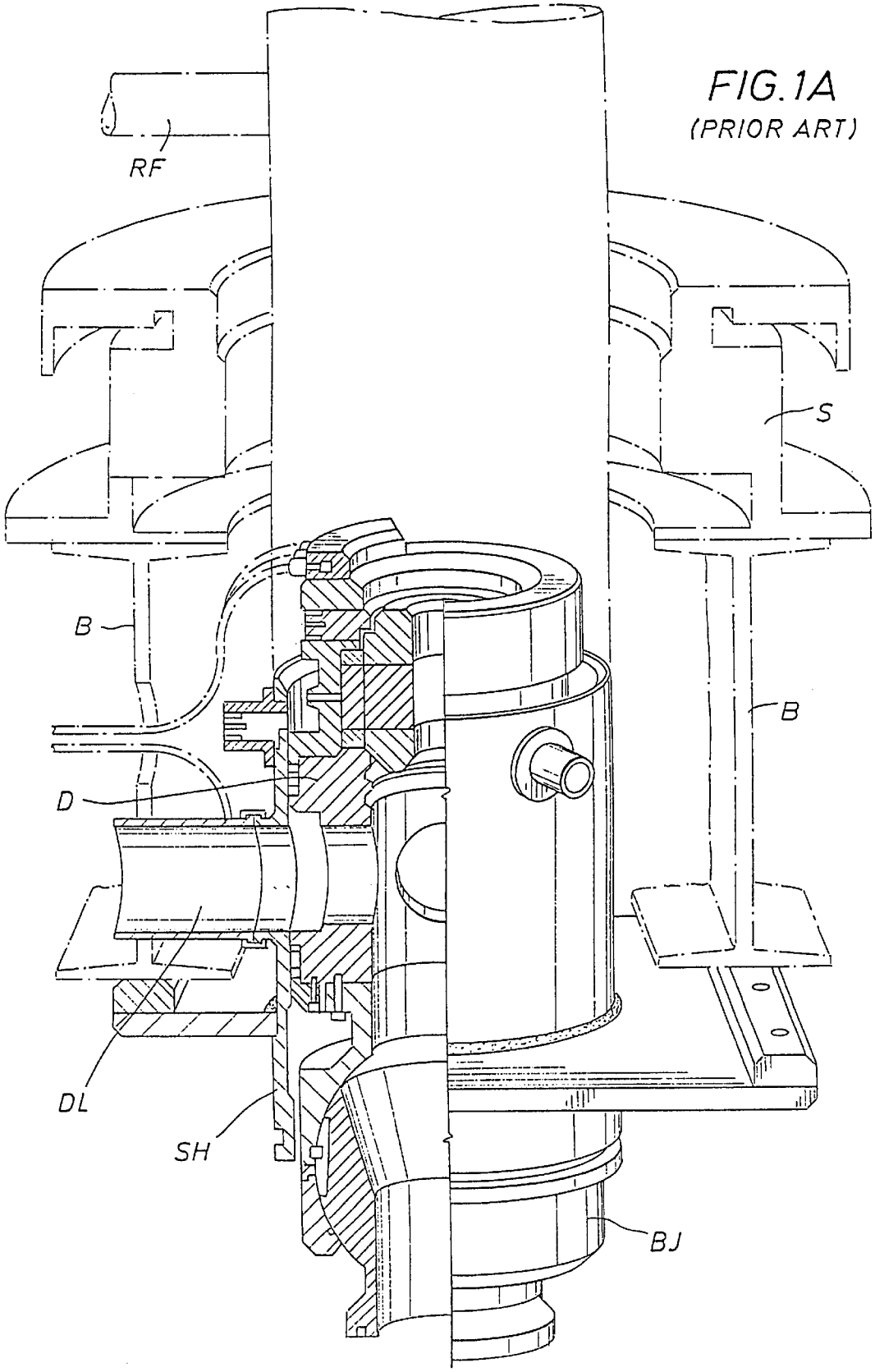
FIG. 1A (PRIOR ART)
FIG. 1A is an enlarged elevational view of a prior art diverter support housing for use with a floating rig.

An adapter 52, having an outer collar 52A similar to the outer barrel collar 36A of outer barrel 36 of the bearing and seal assembly 10A, as shown in FIG. 5, is connected to the seal housing by clamp 44. A diverter assembly DA comprising diverter D, ball joint BJ, crossover 54 and adapter 52 are attached to the seal housing 20 with the quick connect clamp 44. As discussed in detail below, the diverter assembly DA, seal housing 20, adapter 12 and inner barrel IB can be lifted so that the diverter D is directly connected to the floating structure S, similar to the diverter D shown in FIG. 1A, but without the support housing SH.

As can now be understood, in the embodiment of FIG. 4, the seal housing will be at a higher elevation than the seal housing in the embodiment of FIG. 2, since the inner barrel IB has been extended upwardly from the outer barrel OB. Therefore, in the embodiment of FIG. 4, the seal housing would not move independent of the structure S but, as in the conventional mud return system, would move with the structure S with the relative movement being compensated for by the slip and ball joints.

Figure 6:
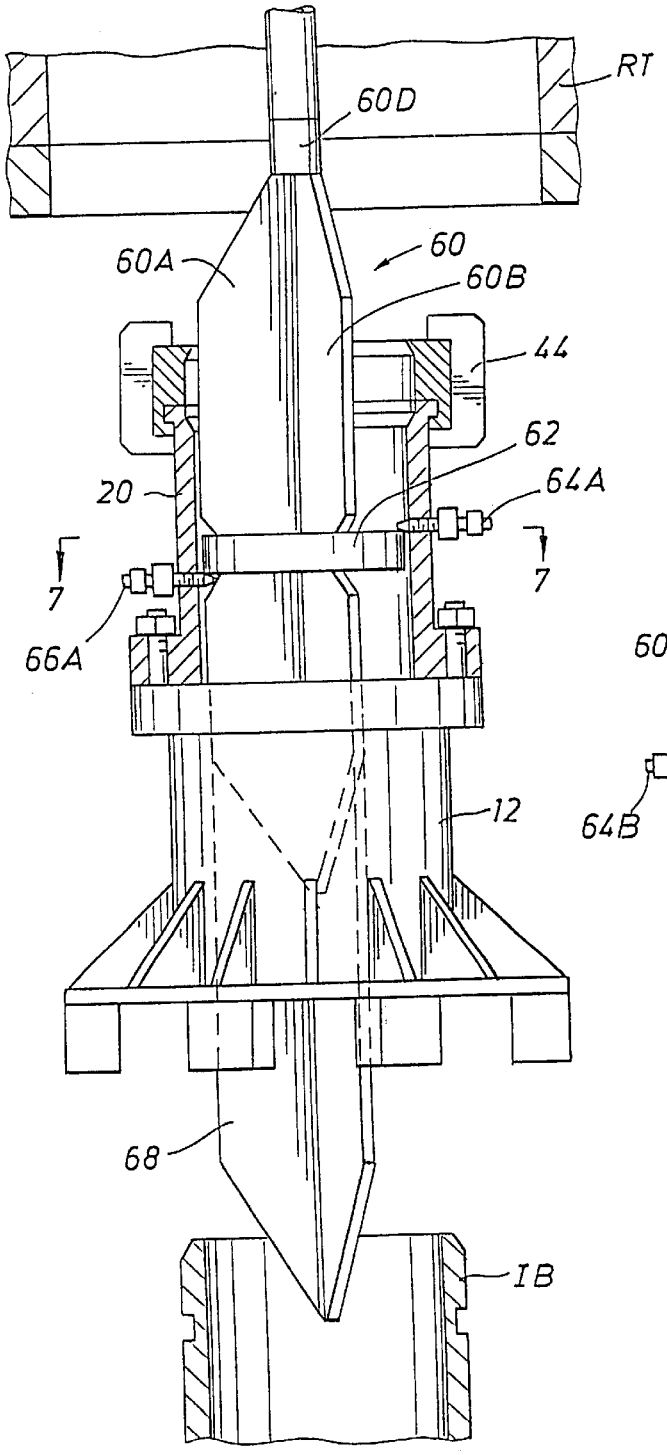
FIG. 6 is an elevational view of an internal running tool and riser guide with the running tool engaging the seal housing of the present invention.
Figure 7:
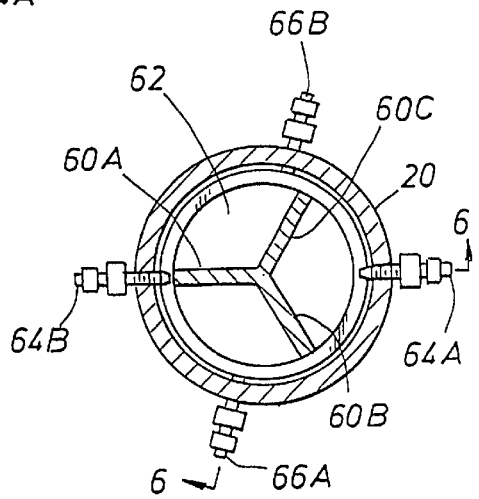
FIG. 7 is a section view taken along lines 7—7 of FIG. 6.
Figure 8:
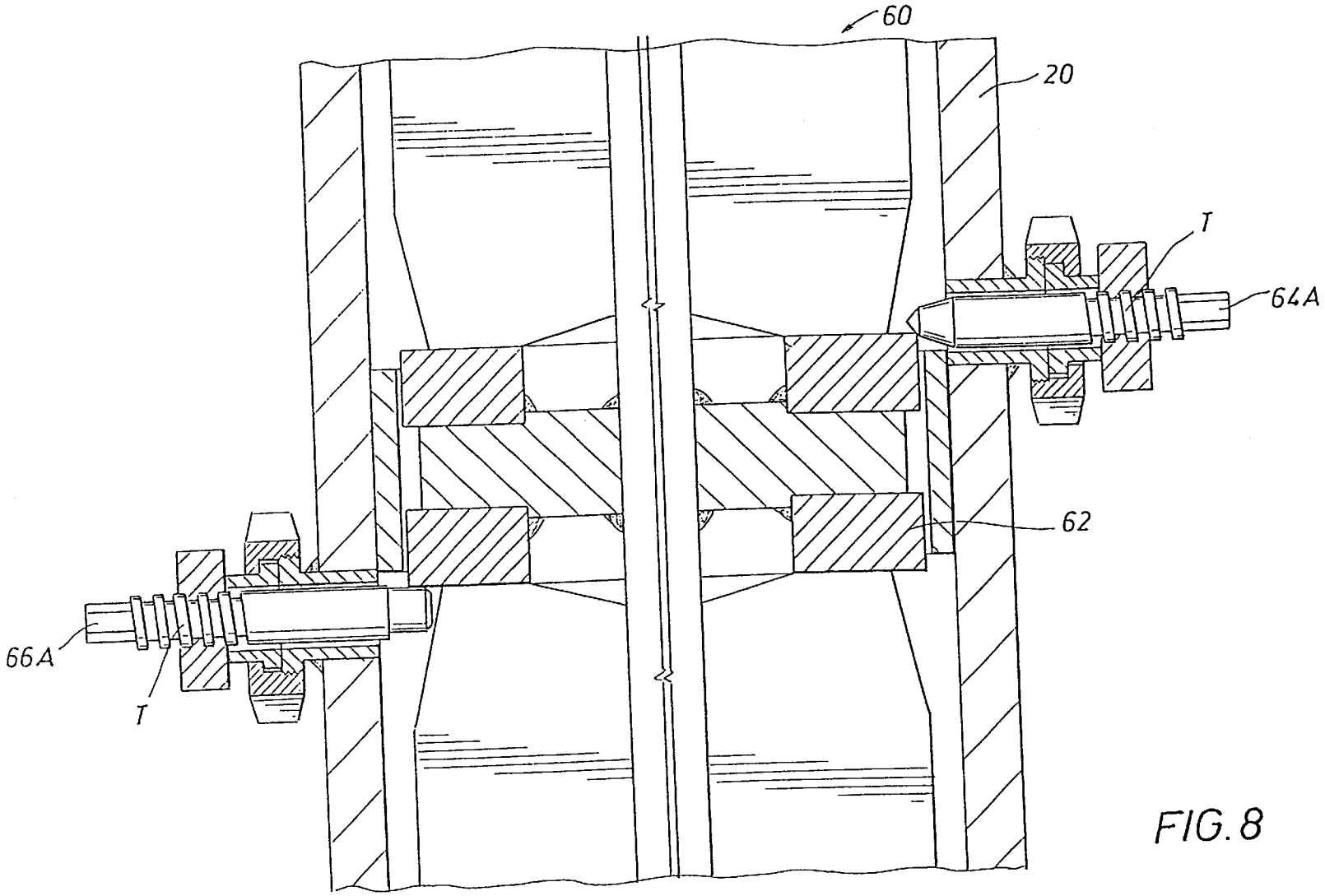
FIG. 8 is an enlarged elevational view of the seal housing shown in section view to better illustrate the locating pins and locking pins relative to the load disk of the present invention.
Figure 9:
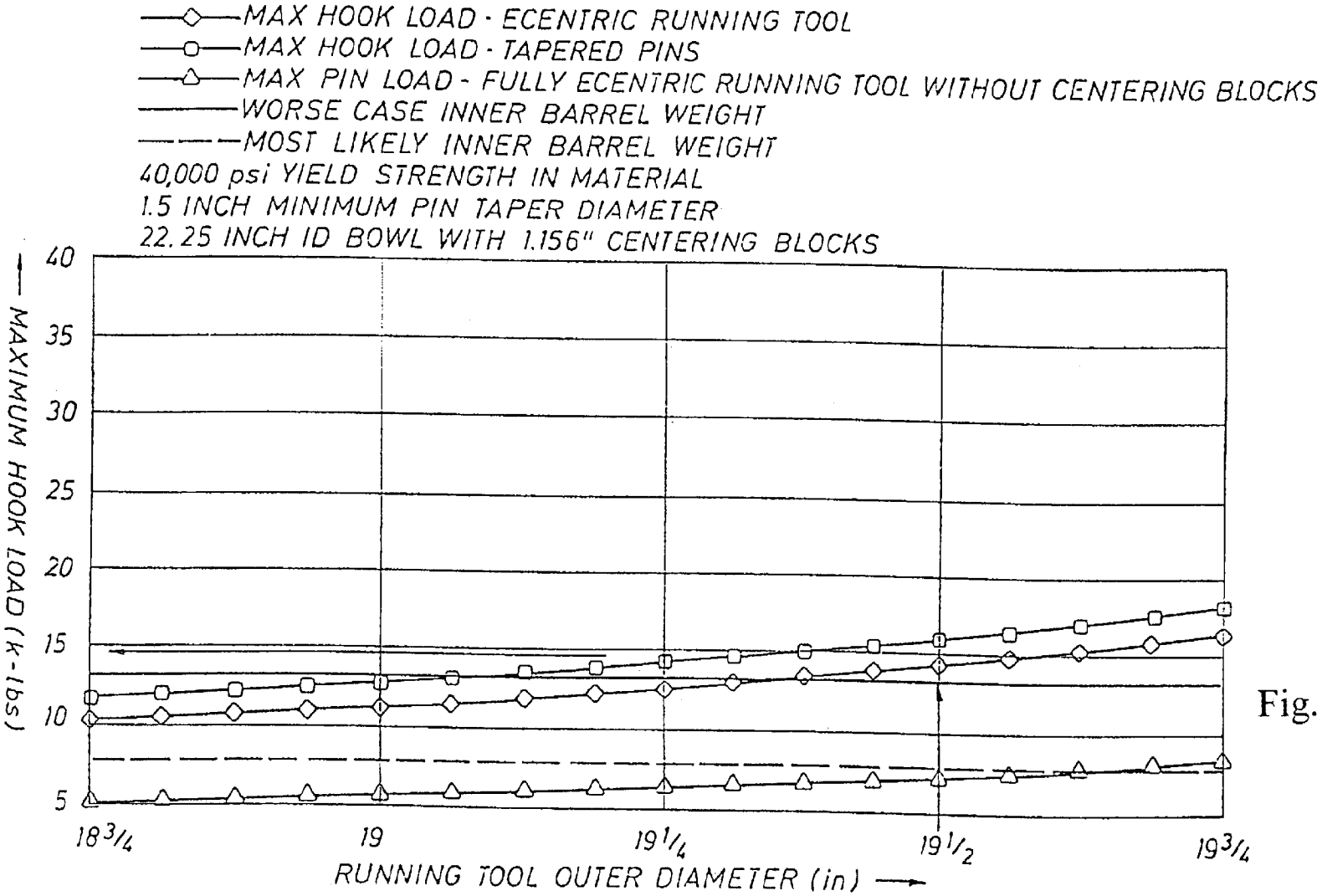
FIG. 9 is a graph illustrating latching pin design curves for latching pins fabricated from mild steel.
Figure 10:
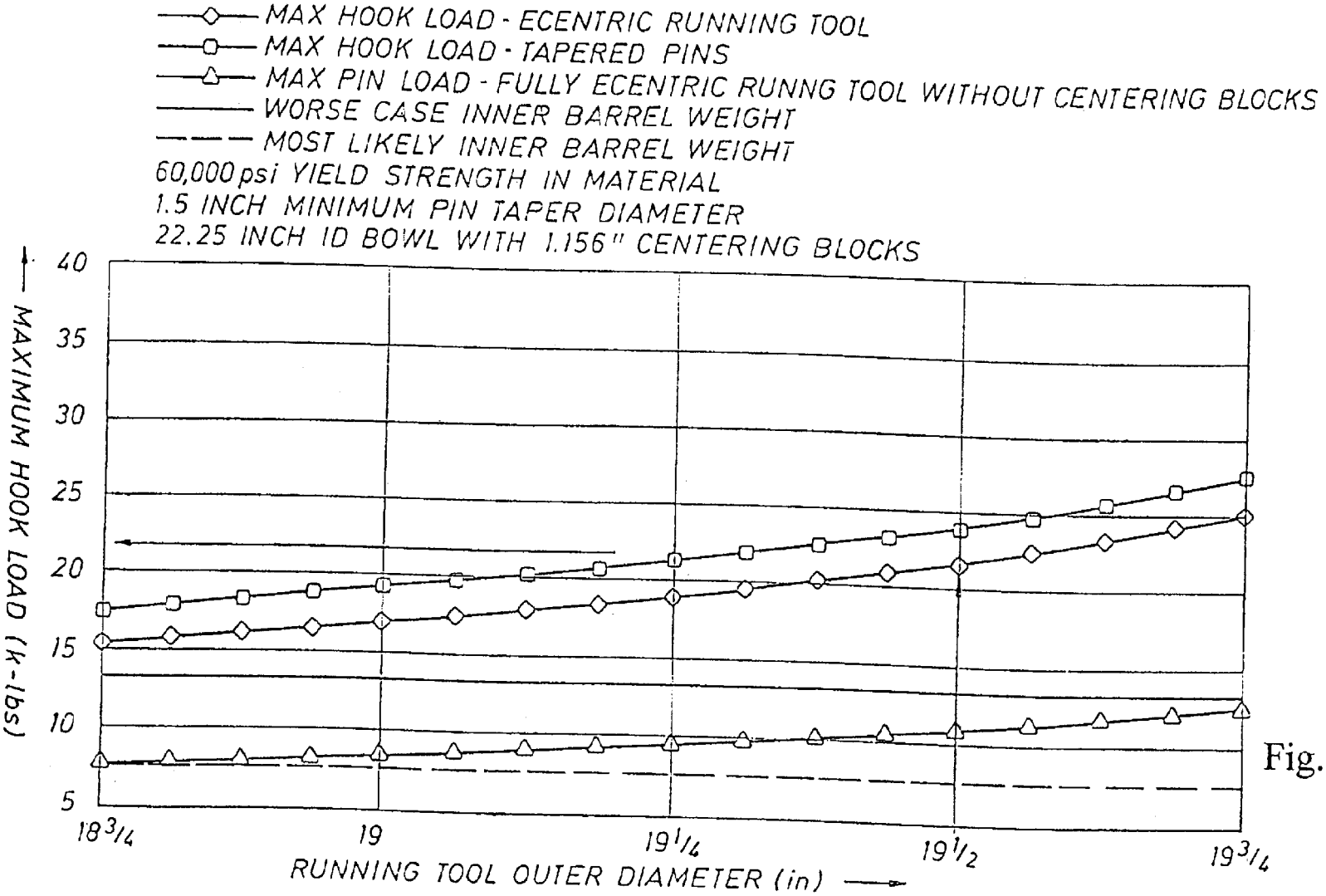
FIG. 10 is a graph illustrating latching pin design curves for latching pins fabricated from 4140 steel.

Turning now to FIG. 6, an internal running tool 60 includes three centering pins 60A, 60B, 60C equally spaced apart 120 degrees. The tool 60 preferably has a 19.5" outer diameter and a 4½" threaded box connection 60D on top. A load disk or ring 62 is provided on the tool 60. As best shown in FIGS. 6 and 7, latching pins 64A, 64B and locating pins 66A, 66B preferably include extraction threads T cut into the pins to provide a means of extracting the pins with a ⅛" hammer wrench in case the pins are bent due to operator error. The latching pins 64A, 64B can be fabricated from mild steel, such as shown in FIG. 9, or 4140 steel case, such as shown in FIG. 10. A detachable riser guide 68 is preferably used with the tool 60 for connection alignment during field installation, as discussed below.

Figure 11:
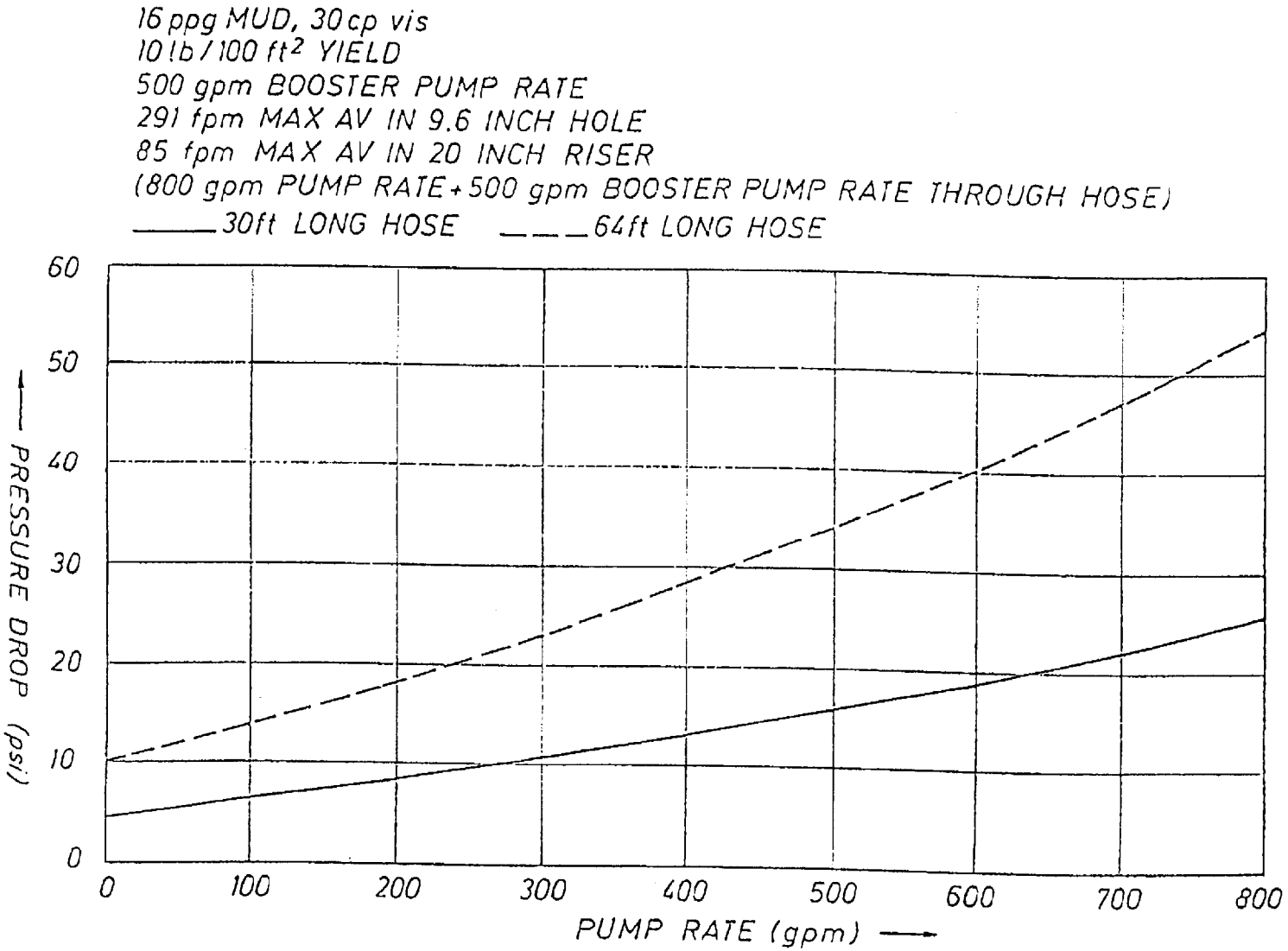
FIG. 11 is a graph illustrating estimated pressure losses in a 4 inch diameter hose.
Figure 12:
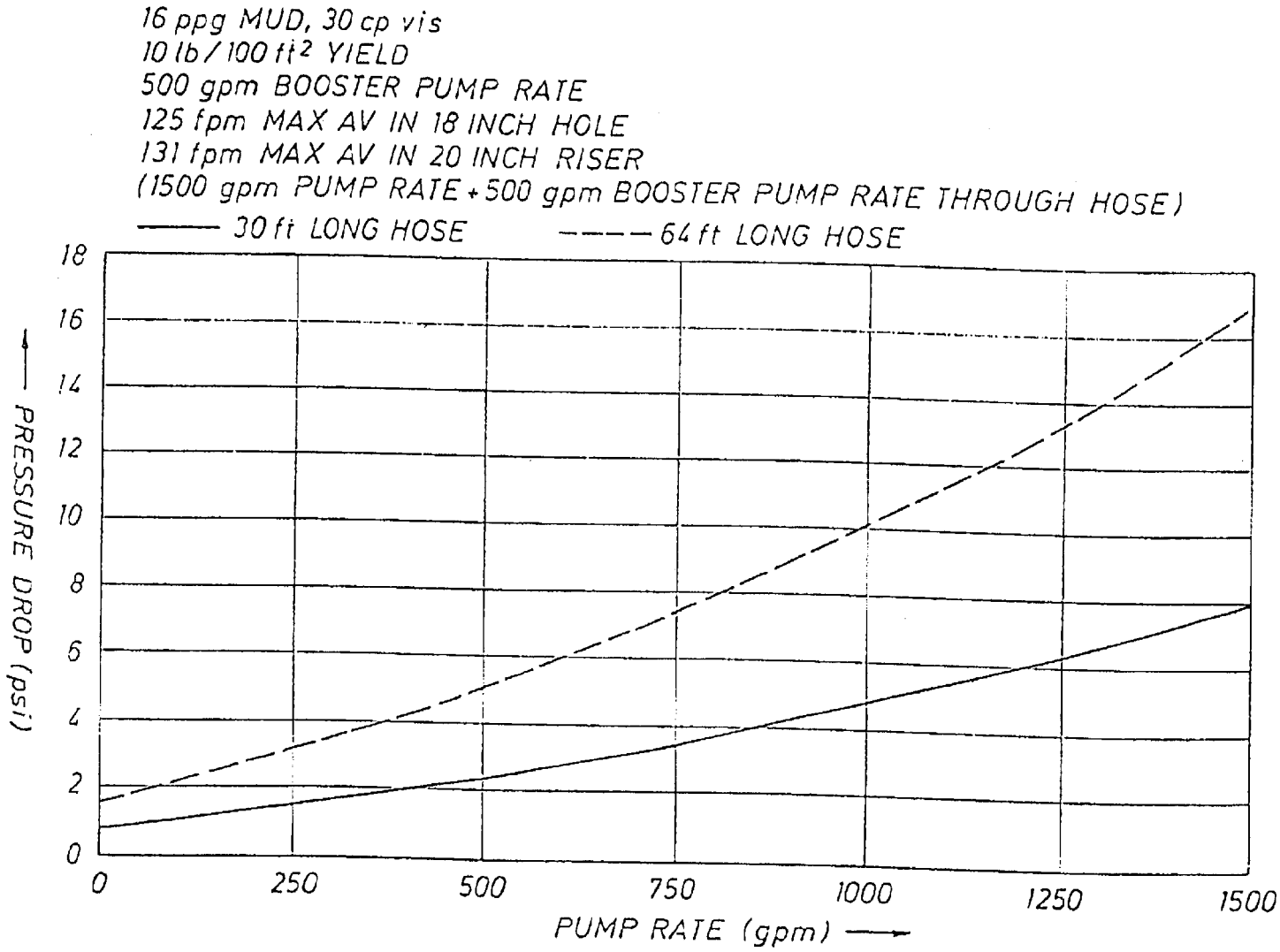
FIG. 12 is a graph illustrating estimated pressure losses in a 6 inch diameter hose.

The conduits 30, 32 are preferably controlled with the use of snub and chain connections (not shown), where the conduit 30, 32 is connected by chains along desired lengths of the conduit to adjacent surfaces of the structure S. Of course, since the seal housing 20 will be at a higher elevation when in a conventional slip joint/diverter configuration, such as shown in FIG. 4, a much longer hose is required if a conduit remains connected to the housing 20. While a 6" diameter conduit or hose is preferred, other size hoses such as a 4" diameter hose could be used, such as discussed in FIGS. 11 and 12.

OPERATION OF USE

After the riser R is fixed to the wellhead W, the blowout preventor stack BOP (FIG. 1) positioned, the flexible choke line CL and kill line KL are connected, the riser tensioners T1, T2 are connected to the outer barrel OB of the slip joint SJ, as is known by those skilled in the art the inner barrel IB of the slip joint SJ is pulled upwardly through a conventional rotary table RT using the running tool 60 removable positioned and attached to the housing 20 using the latching and locating pins, as shown in FIGS. 6 and 7. The seal housing 20 attached to the crossover or adapter 12, as shown in FIGS. 6 and 7, is then attached to the top of the inner barrel IB. The clamp 44 is then removed from the housing 20. The connected housing 20 and crossover 12 are then lowered through the rotary table RT using the running tool 60. The riser guide 68 detachable with the tool 60, is fabricated to improve connection alignment during field installation. The detachable riser guide 68 can also be used to deploy the housing 20 without passing it through the rotary table RT. The bearing and seal assembly 10A is then installed in the housing 20 and the rotatable tubular 14 installed.

If configuration of the embodiment of FIG. 4 is desired, after the tubular 14 has been tripped and the bearing and seal assembly removed, the running tool 60 can be used to latch the seal housing 20 and then extend the unlocked slip joint SJ. The diverter assembly DA, as shown in FIG. 4, can then be received in the seal housing 20 and the diverter assembly adapter 52 latched with the quick connect clamp 44. The diverter D is then raised and attached to the rig floor F. Alternatively, the inner barrel IB of the slip joint SJ can be unlocked and the seal housing 46 lifted to the diverter assembly DA, attached by the diverter D to the rig floor F, with the internal running tool. With the latching and locating pins installed the internal running tool aligns the seal housing 20 and the diverter assembly DA. The seal housing 20 is then clamped to the diverter assembly DA with the quick connect clamp 44 and the latching pins removed. In the embodiment of FIG. 4, the seal housing 20 functions as a passive part of the conventional slip joints/diverter system.

Alternatively, the seal housing 20 does not have to be installed through the rotary table RT but can be installed using a hoisting cable past through the rotary table RT. The hoisting cable would be attached to the internal running tool 60 positioned in the housing 20 and, as shown in FIG. 6, the riser guide 68 extending from the crossover 12. Upon positioning of the crossover 12 onto the inner barrel IB, the latching pins 64A, 64B are pulled and the running tool 60 is released. The bearing and seal assembly 10A is then inserted into the housing 20 after the slip joint SJ is locked and the seals in slip joint are fully pressurized. The connector 16, 18 and conduits 30, 32 are then attached to the seal housing 20.

As can now be understood, the rotatable seals 38, 42 of the assembly 10A seal the rotating tubular 14 and the seal housing 20, and in combination with the flexible conduits 30, 32 connected to a choke manifold CM provide a controlled pressurized mud return system where relative vertical movement of the seals 38, 42 to the tubular 14 are reduced, that is desirable with existing and emerging pressurized mud return technology. In particular, this mechanically controlled pressurized system is particularly useful in underbalanced operations comprising drilling, completions and workovers, gas-liquid and systems and pressurized mud handling systems.

The foregoing disclosure and description of the invention are illustrative and explanatory thereof, and various changes in the details of the illustrated apparatus and construction and method of operation may be made without departing from the spirit of the invention.

What is claimed is:

1. System adapted for use with a structure for drilling in the floor of an ocean using a rotatable tubular and drilling fluid when the structure is floating at a surface of the ocean, the system comprising:

a riser fixed relative to the floor of the ocean and a portion of said riser extending between the floor of the ocean and the surface of the ocean, said riser having a top, bottom and an internal diameter;

a housing disposed on the top of said riser, said housing having a first housing opening and an internal diameter, said first housing opening sized to discharge the drilling fluid received from said riser;

a bearing assembly having an inner member and an outer member and being removably positioned with said housing, said inner member rotatable relative to said outer member and having a passage through which the rotatable tubular may extend;

a seal moving with said inner member to sealably engage the tubular;

a quick disconnect member to disconnect said bearing assembly from said housing; and the floating structure moving independent of said bearing assembly when said tubular is sealed by said seal and the tubular is rotating.

2. System of claim 1 wherein said internal diameter of said housing is substantially the same as the internal diameter of said riser.

3. System of claim 2 wherein when said bearing assembly is removed, said housing permitting substantially full bore access to said riser.

4. System of claim 1 further comprising the structure having a deck above the surface of the ocean, said housing when disposed on said riser positioned above the surface of the ocean and below said deck.

5. System of claim 4 wherein said deck having an opening for receiving a rotary table having removable bushings wherein upon removing said bushings said housing sized for being received through said rotary table.

6. System of claim 1 further comprising a conduit for communicating drilling fluid from said first housing opening to said structure.

7. System of claim 6 wherein said conduit is a flexible hose.

8. System of claim 1 further comprising a second housing opening in said housing and a rupture disc positioned on said second housing opening so that said second opening remaining closed up to a predetermined pressure in said housing.

9. System of claim 6 wherein said conduit having a first end and a second end, said first end connected to said first housing opening and said second end connected to a device for receiving the drilling fluid and fixed to the structure at the surface of the ocean.

10. System of claim 9 further comprising a choke to control pressure in said riser and the seal allowing said choke to control the pressure in said riser.

11. System of claim 1 being free of a slip joint.

12. System of claim 4 further comprising a conduit for communicating drilling fluid from said first housing opening to said structure wherein the drilling fluid is maintained at a predetermined pressure whereby the drilling fluid from the riser flows above said deck to a device for receiving the drilling fluid.

13. System of claim 12 wherein said device is a choke manifold.

14. System adapted for use with a structure for drilling in the floor of an ocean using a rotatable tubular and drilling fluid when the structure is floating at a surface of the ocean, the system comprising:

a riser fixed relative to the floor of the ocean and a portion of said riser extending between the floor of the ocean and the surface of the ocean, said riser having a top, bottom and an internal diameter;

a housing disposed on the top of said riser, said housing having a first housing opening and an internal diameter, said first housing opening sized to discharge the drilling fluid received from said riser;

a bearing assembly having an inner member and an outer member, said inner member rotatable relative to said outer member and having a passage through which the rotatable tubular may extend;

a seal moving with said inner member to sealably engage the tubular; and a flexible conduit for communicating the drilling fluid from said first housing opening to said structure whereby the structure moving independent of said housing when said tubular is sealed by said seal and the tubular is rotating and said flexible conduit compensating for the relative movement of the structure and said housing while communicating the drilling fluid from the housing to the structure.

15. System of claim 14 wherein the relative movement includes a vertical component.

16. System of claim 15 wherein the relative movement includes a horizontal component.

17. System of claim 14 wherein said conduit having a first end and a second end, said first end connected to said first housing opening and said second end connected to a device for receiving the drilling fluid and fixed to the structure at the surface of the ocean.

18. System of claim 17 further comprising pressure in said riser wherein said device controls the pressure in the riser.

19. System of claim 14 being free of a slip joint.

20. System of claim 14 wherein the drilling fluid is maintained at a predetermined pressure whereby the drilling fluid from the riser flows to the structure above the surface of the ocean to a device for receiving the drilling fluid.

21. Method for sealing a riser while drilling in the floor of an ocean from a structure floating at a surface of the ocean using a rotatable tubular and pressurized drilling fluid, comprising the steps of:

fixing the position of the riser relative to the floor of the ocean;

positioning a housing above the riser;

allowing the housing to move independent of said floating structure;

rotating the tubular within the housing and the riser while maintaining a seal between the tubular and the housing;

communicating the pressurized drilling fluid from the housing to the structure, and compensating for the relative movement of the structure and the housing during the step of communicating.

22. Method of claim 21 further comprising the step of:

attaching a flexible conduit between an opening of the housing and the floating structure for the step of compensating for the relative movement of the structure and the housing.

23. Method of claim 21 further comprising the step of:

removing a bearing assembly from the housing whereby the housing internal diameter is substantially the same as the riser internal diameter.

24. Method of claim 21 further comprising the step of:

lowering the housing through a deck of the structure during the step of positioning the housing on the riser.

25. Method of claim 21 wherein the step of compensating is independent of a slip joint.

26. Method for communicating drilling fluid from a casing fixed relative to an ocean floor to a structure floating at a surface of the ocean while rotating within the casing a tubular, comprising the steps of:

positioning a housing on a first level of the floating structure and sealingly attaching the housing to the casing;

allowing the housing to move independent of said floating structure;

sealingly positioning the tubular with the housing so that the tubular extends through the housing and into the casing;

pressurizing the drilling fluid to a predetermined pressure as the fluid flows into the tubular;

moving the fluid from the tubular up the casing to a second level of the floating structure above the housing; and rotating the tubular relative to the housing while maintaining the seal between the tubular and the housing.

27. Method of claim 26 further comprising the step of:

compensating for the relative movement of the structure and the housing during the step of moving.

28. Method of claim 27 wherein the relative movement includes a vertical component.

29. Method of claim 28 wherein the relative movement includes a horizontal component.

30. Method of claim 26 wherein a flexible conduit is positioned between the housing and floating structure for the step of compensating for the relative movement.

* * * * *